US007234180B2

(12) United States Patent
Horton et al.

(10) Patent No.: US 7,234,180 B2
(45) Date of Patent: Jun. 26, 2007

(54) DYNAMIC SURGICAL TABLE SYSTEM

(75) Inventors: William C. Horton, Decatur, GA (US); Matthew M. Morrison, Cordova, TN (US); Harold Sparr Taylor, Memphis, TN (US); Douglas Baker, Germantwon, TN (US)

(73) Assignee: Warsaw Orthopedic, Inc., Warsaw, IN (US)

( * ) Notice: Subject to any disclaimer, the term of this patent is extended or adjusted under 35 U.S.C. 154(b) by 152 days.

(21) Appl. No.: 11/009,745

(22) Filed: Dec. 10, 2004

(65) Prior Publication Data

US 2006/0123546 A1 Jun. 15, 2006

(51) Int. Cl.
*A61G 13/08* (2006.01)

(52) U.S. Cl. ..... 5/613; 5/621; 5/622; 5/623; 5/624

(58) Field of Classification Search ..... 5/600, 5/612, 613, 619, 621–624, 646–651; 128/845
See application file for complete search history.

(56) References Cited

U.S. PATENT DOCUMENTS 3,227,440 A * 1/1966 Scott ..... 5/618
3,599,964 A * 8/1971 Magni ..... 5/624
3,745,996 A * 7/1973 Rush, Sr. ..... 602/39
4,552,346 A * 11/1985 Schnelle et al. ..... 5/619
4,712,781 A 12/1987 Watanabe
4,840,362 A 6/1989 Bremer et al.
4,872,656 A * 10/1989 Brendgord et al. ..... 5/601
5,131,106 A 7/1992 Jackson
6,076,525 A 6/2000 Hoffman
6,154,901 A 12/2000 Carr
6,202,230 B1 * 3/2001 Borders ..... 5/618
6,286,164 B1 * 9/2001 Lamb et al. ..... 5/600

OTHER PUBLICATIONS

The Effect of the Prone Position on Venous Pressure and Blood Loss During LUmbar Laminectomy; J. Clin. Anesth., vol. 4, May/Jun. 1992.
Taking the O.R. to the Office, Patient Positioning During Surgical Procedures; Plastic Surgical Nursing/Winter 1994, vol. 14, No. 4.
The Effect of Operative Position on Lumbar Lordosis; SPINE vol. 20, No. 12, pp. 1419-1424, 1995.

(Continued)

*Primary Examiner*—Michael Trettel
(74) *Attorney, Agent, or Firm*—Krieg DeVault LLP

(57) ABSTRACT

A dynamic surgical table system includes any one or combination of a head support system, support systems for each arm, a torso support system, and a leg support system mounted to a frame system to support a patient during surgery. Any one or combination of the support systems is movable relative to the other and to the frame system to facilitate patient repositioning during surgery. Such repositioning may be desirable, for example, to create flexion, extension or rotation of the spine to facilitate access to and surgical treatment of one or more vertebral bodies, disc spaces between vertebral bodies, or other anatomical structures adjacent the spine of the patient. Furthermore, individual support members of any one of the support systems can articulate to conform to the patient anatomy and facilitate repositioning of the particular portion of the patient's body being support thereon while minimizing stress on the patient.

57 Claims, 4 Drawing Sheets

OTHER PUBLICATIONS

Positioning the Patient for Surgery, British Jouranl of Theatre Nursing, vol. 6, No. 5, Aug. 1996.

The Effects of Neutral Positioning with and without Padding on Spinal Immobilization of Healthy Subjects; Prehospital Emergency Care Apr./Jun. 1998, vol. 2/No. 2.

David G. Vossler MD et al., Femoral Artery Ischemia During Spinal Scoliosis Surgery Detected by Posterior Tibial Nerve Somatosensory-Evoked Potential Monitoring, SPINE, 2000, pp. 1457-1459, vol. 25, No. 11, Copyright 2000 Lippincott Williams & Wilkins, Inc.

Anthony F. Guanciale MD et al., Lumbar Lordosis in Spinal Fusion: A Comparison of Intraoperative Results of Patient Positioning on Two Different Operative Table Frame Types, SPINE, Apr. 15, 1996, pp. 964-969. vol. 21(8). Copyright Lippincott-Raven Publishers.

Roger P. Jackson MD et al., Lumbopelvic Lordosis and Pelvic Balance on Repeated Standing Lateral Radiographs of Adult Volunteers and Untreated Patients With Constant Low Back Pain, SPINE, 2000, pp. 575-586, vol. 25, No. 5, Copyright 2000 Lippincott Williams & Wilkins, Inc.

J. Legaye et al., Pelvic Incidence: A Fundamental Pelvic Parameter for Three-Dimensional Regulation of Spinal Sagittal Curves, Eur Spine J, 1998, pp. 99-103, vol. 7, Copyright Springer-Verlag 1998.

Joseph G. Marsicano MD et al., The Lordotic Effect of the OSI Frame on Operative Adolescent Idiopathic Scoliosis Patients, SPINE, Jun. 15, 1998, pp. 1341-1348, vol. 23(12), Copyright Lippincott-Raven Publishers.

Yigal Mirovsky MD et al., Injuries to the Lateral Femoral Cutaneous Nerve During Spine Surgery, SPINE, 2000, pp. 1266-1269, vol. 25, No. 10, Copyright 2000 Lippincott Williams & Wilkins, Inc.

Gregory A. Nuttall MD et al., Predictors of Blood Transfusions in Spinal Instrumentation and Fusion Surgery, SPINE, 2000, pp. 596-601, vol. 25, No. 5, Copyright 2000 Lippincott Williams & Wilkins. Inc.

Clifford B. Tribus MD et al., The Effect of Operative Position and Short-Segment Fusion on Maintenance of Sagittal Alignment of the Lumbar Spine, SPINE, Jan. 1, 1999, pp. 58-61, vol. 24(1), Copyright 1999 Lippincott Williams & Wilkins, Inc.

* cited by examiner

DYNAMIC SURGICAL TABLE SYSTEM

BACKGROUND

Surgical tables are employed during surgery to support the patient in a position that provides access to internal portions of the patient's body to be subject to surgical procedures. The ability to manipulate the patient's limbs, head and/or torso during the surgery can be limited by the design and functioning of the surgical table. Furthermore, the contact areas between the table and the patient can create pressure points on the patient. During long procedures, these pressure points can create post-operative sores and irritation for the patient.

It is sometimes necessary to reposition the patient during surgery. Such repositioning may involve time-consuming lifting and movement of the patient and placement of pads between the patient and the surgical table. In addition, the areas of contact between the table and the patient may create sores and irritation through friction or rubbing the skin of the patient as the patient is repositioned during surgery.

SUMMARY

A dynamic surgical table system is provided that allows the patient to be repositioned during surgery to a desired position for a surgical approach to the spine. Support members of the surgical table system may be independently movable to reduce contact pressure and soreness in the patient during the surgical procedure, and to reduce friction or rubbing between the patient and the support members during repositioning. The surgical table system can be employed to support the patient in any one of the prone, supine, lateral and anterior-lateral positions.

According to one aspect, there is provided a dynamic surgical table system that includes any one or combination of a head support system, a support system for each arm, a torso support system, and a leg support system. The support systems are mountable to a frame system to support a patient during spinal surgery, although applications with other types of surgery are also contemplated. Any one or combination of the support systems is movable relative to the others to facilitate patient repositioning during surgery. Such repositioning may be desirable, for example, to create flexion, extension or rotation of any one or more vertebral levels of the spine to facilitate access to and surgical treatment of one or more vertebral bodies, disc spaces between vertebral bodies, or other anatomical structures adjacent the spine of the patient. Furthermore, individual support members of any one of the support systems may be articulable to accommodate patient anatomy and patient movement during surgery to reduce or eliminate pressure and friction sores.

According to another aspect, a surgical table system includes individual support members comprising any one of a number of support systems of the table. Any support member may include a supporting surface that reduces the pressure on the patient's body through padding and/or adjustment features. The adjustment features may allow the support member to be adjusted relative to the body portion of the patient being supported thereon. For example, the support member may include one or more rollers, inflatable portions, or other feature that allows the adjustment in the positioning, pressure distribution, or treatment to the body portion of the patient supported thereon.

According to one aspect, a surgical table system for supporting a patient during a spinal surgical procedure includes a frame system to support the surgical table system above the ground and a plurality of support systems. At least one support system is provided for each of the head, torso, arm, and legs of the patient to support the patient in a position during the surgical procedure. The torso support system is structured to support a torso of the patient generally in a first plane and the leg support system is movable relative to the torso support system from a first position where a lumbar portion of the spine is placed in flexion with knees of the patient below the first plane to a second position where the lumbar portion of the spine is placed in extension with knees of the patient above the first plane. Other examples contemplate that any one or combination of the support systems are movable to place the spinal column in traction, compression, or to apply a lateral force along a side of the patients body to laterally flex, extend, or rotate the spinal column.

According to another aspect, a surgical table system for supporting a patient during a spinal surgical procedure includes a frame system to support the surgical table system above the ground and a torso support system, a leg support system, and a head support system mounted to the frame system to support the patient in a position during the surgical procedure. The torso support system is structured to support a torso of the patient generally in a first plane. The leg support system is movable relative to the first plane between first and second positions so that a lumbar portion of the spine can be manipulated for flexion and extension and the head support system is movable between first and second positions relative to the first plane so that a cervical portion of the spine of the patient can be manipulated for flexion and extension.

According to another aspect, a surgical table system for supporting a patient during a spinal surgical procedure includes a frame system to support the surgical table system above the ground and a plurality of support systems. At least one support system is provided for each of the torso, arm, and legs of the patient to support the patient in a position during the surgical procedure. Each of the arm support systems includes an upper arm support member for supporting the upper arm and a lower arm support member for supporting the lower arm. The leg support system includes a pair of lower leg support members for respective ones of the lower legs of the patient and a pair of upper leg support members for respective ones of the upper legs of the patient. Each of the support members is articulably mounted to an adjacent support arm.

The support members can be positioned against the skin of the patient or can be in the form of pins or other connection members engaged to the skeletal structure of the patient. For example, connection members can be engaged to provide skeletal support cranially, to one or more portions of either or both arms, or to one or more portions of either or both legs. The connection members can eliminate surface area support, and can provide greater access with respect to the supported portion of the patient's body while maintaining maneuverability and the ability to reposition the supported body portions of the patient.

According to a further aspect, a surgical table system for supporting a patient during a spinal surgical procedure includes a frame system to support the surgical table system above the ground and a plurality of support systems. At least one support system is provided for each arm, the torso, and legs of the patient to support the patient in a position during the surgical procedure. Each of the support systems includes at least two articulable support members for supporting a respective adjacent body portion of the patient thereon.

These and other aspects are also discussed below.

DESCRIPTION OF THE ILLUSTRATED EMBODIMENTS

Figure 1:
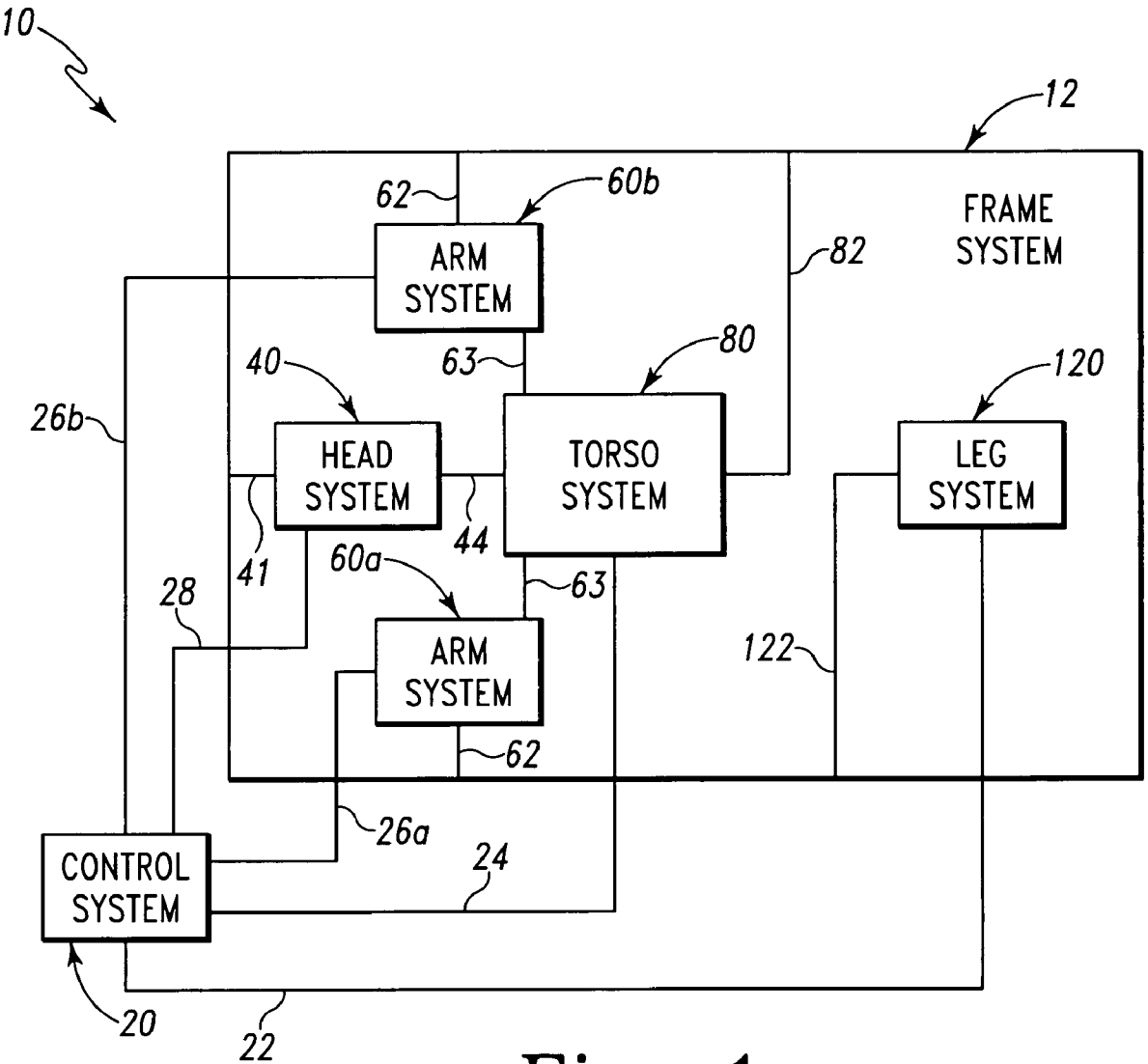
FIG. 1 is a schematic of a surgical table system.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring now to FIG. 1, there is shown a schematic of a dynamic surgical table system 10. Surgical table system 10 includes a frame system 12 that supports the patient above the floor or ground level during surgery. Frame system 12 further supports a head support system 40, a torso support system 80, arm support systems 60, and a leg support system 120. Any one or combination of these support systems 40, 60, 80, 120 are movable relative to the other support systems and frame system 12 to reposition the body of the patient as may be desired during, for example, spinal surgery with the patient supported thereon in the prone position. Such adjustment may be employed to induce flexion, extension, elongation, compression, and/or rotation of the spinal column to facilitate surgeon access to structures of the spinal column during surgery. Still further, any one or combination of these systems or support members of these systems may articulate to reduce localized stress on the body of the patient caused by repositioning the patient during surgery. The articulating support members also reduce pressure sores and other conditions resulting from lack of movement of the patient relative to the support surfaces of the support members for long periods of time during surgery. Still further any one or combinations of these systems can be configured to support the patient in supine, lateral, or anterior-lateral positions. The surgical table system may be employed for procedures other than spinal surgery, including cranial, thoracic, abdominal, arm, leg, hip, or any other surgery.

Support systems 40, 60, 80, 120 are mounted directly to frame system 12, or indirectly mounted to frame system 12 through one or more of the other support systems. For example, leg support system 120 is mounted to frame system 12 with mounting system 122. Mounting system 122 may be adjustable along frame system 12 to reposition leg support system 120 relative to torso support system 80. Torso support system 80 is mounted to frame system 12 with mounting system 82, and arm support systems 60 are mounted to frame system 12 with mounting system 62 or torso support system 80 with mounting system 63. Head support system 40 can be mounted either to frame system 12 with support system 41 or to torso support system 80 with support system 44. It is further contemplated that any one or combination of head support system 40 and arm support systems 60 may be adjustable relative to frame 12 and/or torso support system 80 to accommodate the physical stature and desired positioning of the patient.

As used herein, elements of the various support systems located on a first side of central axis are designated with a reference numeral followed by the letter "a", and elements on a second side of the central axis are designated with a reference numeral followed by the letter "b". When referred to collectively, the "a" or "b" designation after the reference numeral may be omitted. For example, first and second leg supports 121*a*, 121*b* may be collectively referred to as leg supports 121.

Figure 2:
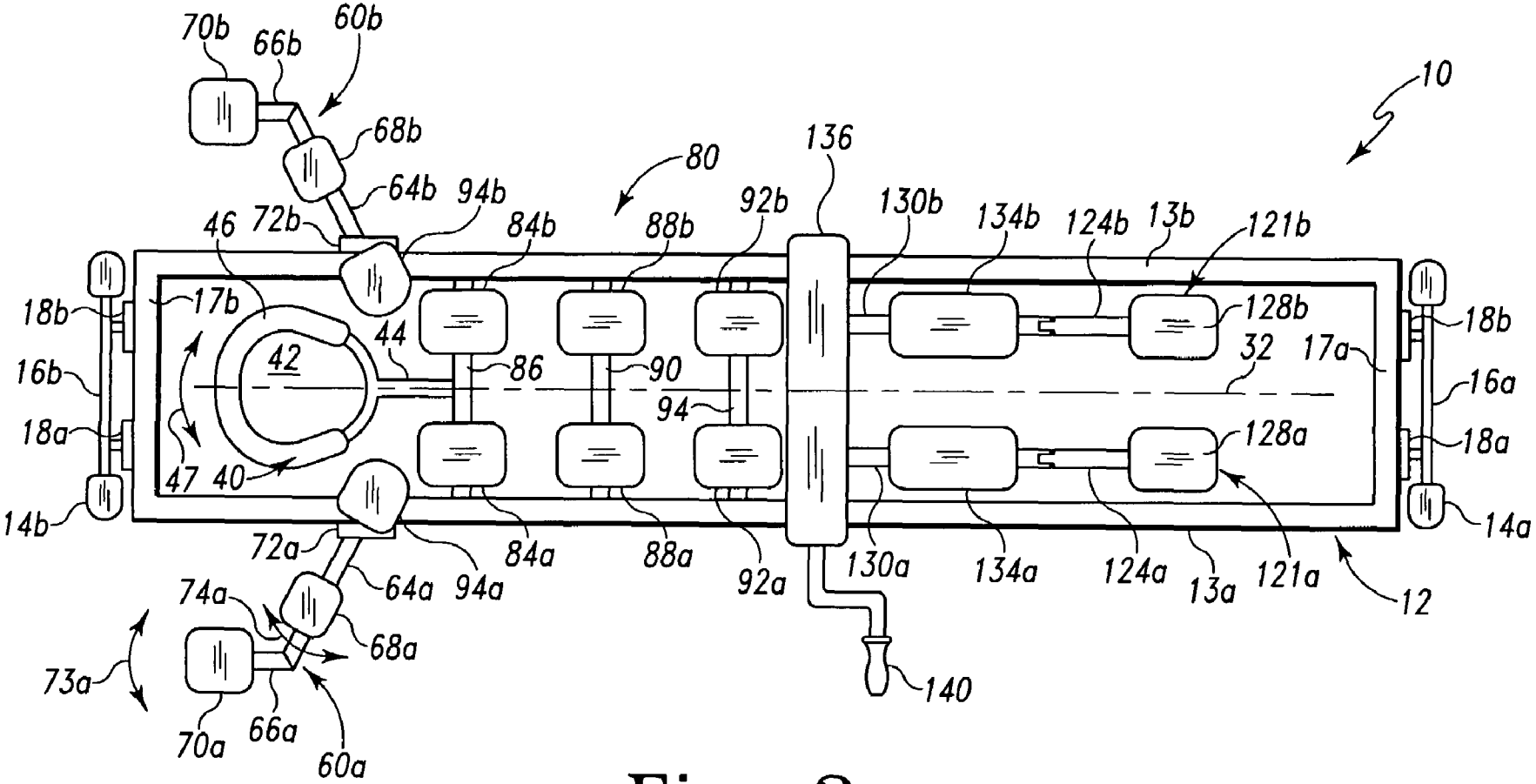
FIG. 2 is a diagrammatic form plan view of one embodiment surgical table system.
Figure 3:
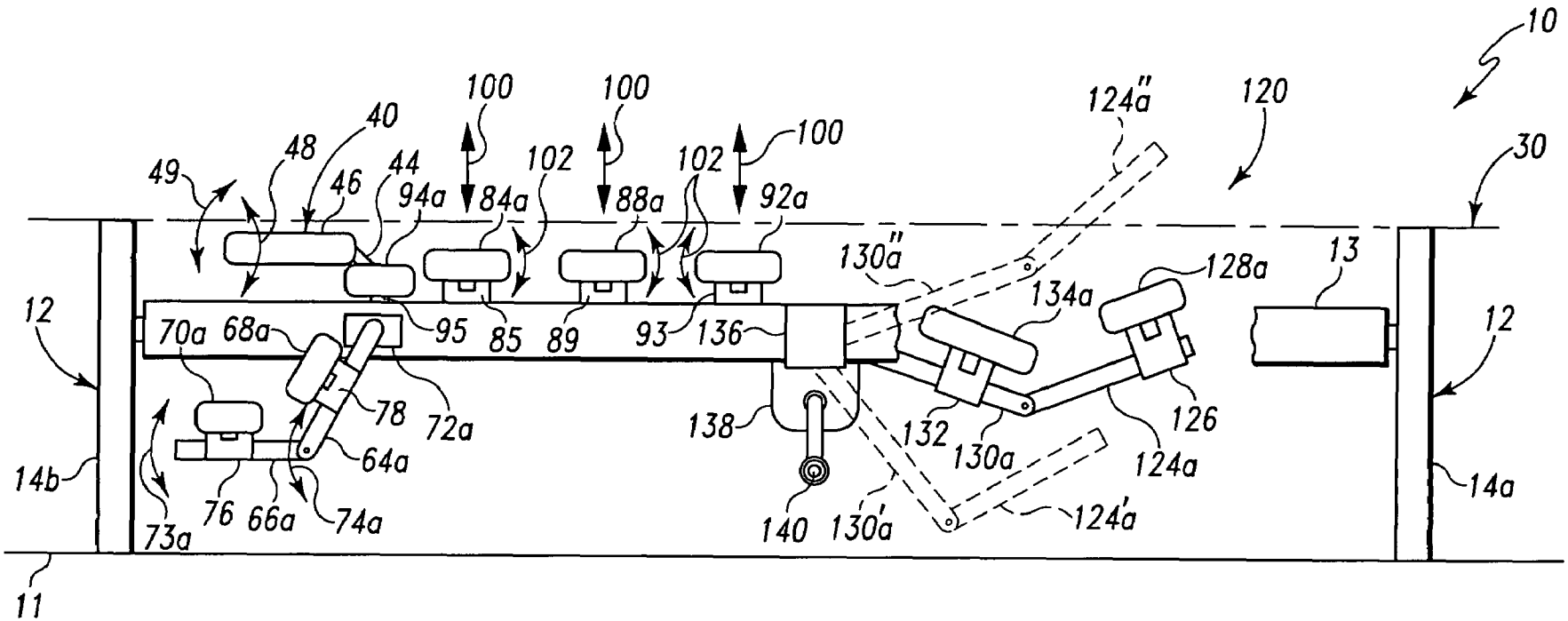
FIG. 3 is an elevation view of the surgical table system with the frame system partially broken away to show the leg support system.

Referring to FIGS. 2 and 3, there are shown a plan view and an elevation view, respectively, of one embodiment surgical table system 10. Frame system 12 includes longitudinal frame members 13*a*, 13*b* interconnected by end frame members 17*a*, 17*b*. Frame members 13*a*, 13*b*, 17*a*, 17*b* define an opening therebetween which houses leg support system 120, torso support system 80 and head support system 40. Post members 14*a*, 14*b* are provided at respective ends of frame system 12 to support frame members 13*a*, 13*b*, 17*a*, 17*b* above floor 11. In one embodiment, brackets 18*a*, 18*b* extend from each of the end members 17*a*, 17*b* and can be coupled to a respective one of the engaging members 16*a*, 16*b*. Engaging members 16*a*, 16*b* can be configured for removable engagement with the respective post member 14*a*, 14*b* at any one of a plurality of locations therealong to allow adjustment in the height of frame members 13*a*, 13*b*, 17*a*, 17*b* above floor 11.

Other embodiments contemplate other means for supporting frame system 12 above the floor. For example, there may be provided a single post or cylinder centrally positioned between frame members 13, 17. There may be provided members structured to support frame system 12 off of a wall and/or ceiling of the operating room. The posts or other structure supporting the frame system above the floor can be adjustable in height through manipulation of cylinders, jacks, or levers, for example. The one or more posts or other support structure may further include casters, wheels or other suitable devices to facilitate transportation of surgical table system 10.

Leg support system 120 includes a first leg support 121*a* with an upper leg support arm 130*a* articulably supporting an upper leg support member 134*a*. A lower leg support arm 124*a* is articulably coupled to upper leg support arm 130*a* and includes a lower leg support member 128*a* articulably mounted thereto. There is similarly provided a second leg support 121*b* extending parallel to and spaced from first leg support 121*a*. Second leg support 121*b* includes an upper leg support arm 130*b* and an upper leg support member 134*b* articulably mounted thereto. A lower leg support arm 124*b* is articulably coupled to upper leg support arm 130*b* and includes a lower leg support member 128*b* articulably mounted thereto. First and second leg supports 121*a*, 121*b* extend along and generally parallel to a central longitudinal axis 32, which is generally alignable with the central axis of the patient positioned on surgical table system 10 during surgery.

With the patient positioned on surgical table system 10, in the prone position for example, the upper legs or thighs of the patient are supported on respective ones of the upper leg support members 134*a*, 134*b*, and the lower legs or shins of the patient are supported on respective ones of the lower leg support members 128*a*, 128*b*. The torso of the patient is supported by torso support system 80 generally parallel to a first plane 30. The first and second leg supports 121*a*, 121*b* are located between frame members 13*a*, 13*b*, and are movable therebetween between a first position where the lumbar portion of the spine is in flexion and a second position where the lumbar portion of the spine is in extension. As shown in FIG. 3, the first position is indicated by support arms 124*a*', 130*a*'. The support arms 124, 130 are located so that the respective support members 128, 134 mounted thereon are below first plane 30 with the knees of the patient bent between the respective support arms 124 and 130 at approximately 90 degrees. In the second position, indicated by support arms 124*a*", 130*a*", the support members 134 on supports arms 130 are located adjacent to or above plane 30, and the support members 128 on support arms 124 are located above plane 30. The knees of the patient are slightly flexed in the second position.

Lower leg support arm 124*a* is articulably coupled at one end to an end of upper leg support arm 130*a*. The opposite end of upper leg support arm 130*a* is mounted to frame system 12 through a leg positioner system 136. Similarly, lower leg support arm 124*b* is pivotally coupled at one end to an end of upper leg support arm 130*b*, and the opposite end of upper leg support arm 130*b* is mounted to frame system 12 through leg positioner system 136.

Leg positioner system 136 includes any suitable structure that is rotatable in housing 138, including axles, gears, pivot arms, linkages, and other structures configured to engage upper leg support arms 130 and impart movement thereto to allow movement of leg support system 120 between the first and second positions discussed above. Each of the upper leg support arms 130 are coupled to in housing 138 so that rotation of the rotatable structure with crank 140 causes upper leg support arms 130 to move in conjunction with one another between the first and second positions. Lower leg support arms 124 are pivotally journalled to the respective upper leg support arms 130 so that the lower leg support arms 124 follow and pivot relative to the respective upper leg support arms 130 as the upper leg support arms are moved between the first and second positions. The pivotal connection between the upper leg support arms 130 and the respective lower leg support arms 124 mimic a range of motion of the knee joints as the upper leg support arms 130 are moved to mimic the range of motion of the hip joints and lower back. Leg positioner system 136 can further be configured to maintain or lock leg support system 120 at either the first or second positions or any position therebetween during the surgery.

As shown in FIG. 3, each of the upper and lower leg support members 134, 128 can be mounted to the respective support arms 130, 124 with mounting members 132, 126, respectively. Mounting members 126, 132 can be configured so that respective support member 128, 134 support thereby can articulate for adjustment in positioning of the individual support member relative to the support arm. It is contemplated that the articulating supporting members can move by any one or combination of pivoting, translating, elongating, compressing, and/or adjusting in height relative to the support arm to which the support member is mounted. The articulating support members are dynamically positionable relative to frame system 12 to statically support the patient during repositioning and movement of the patient during surgery.

Figure 4:
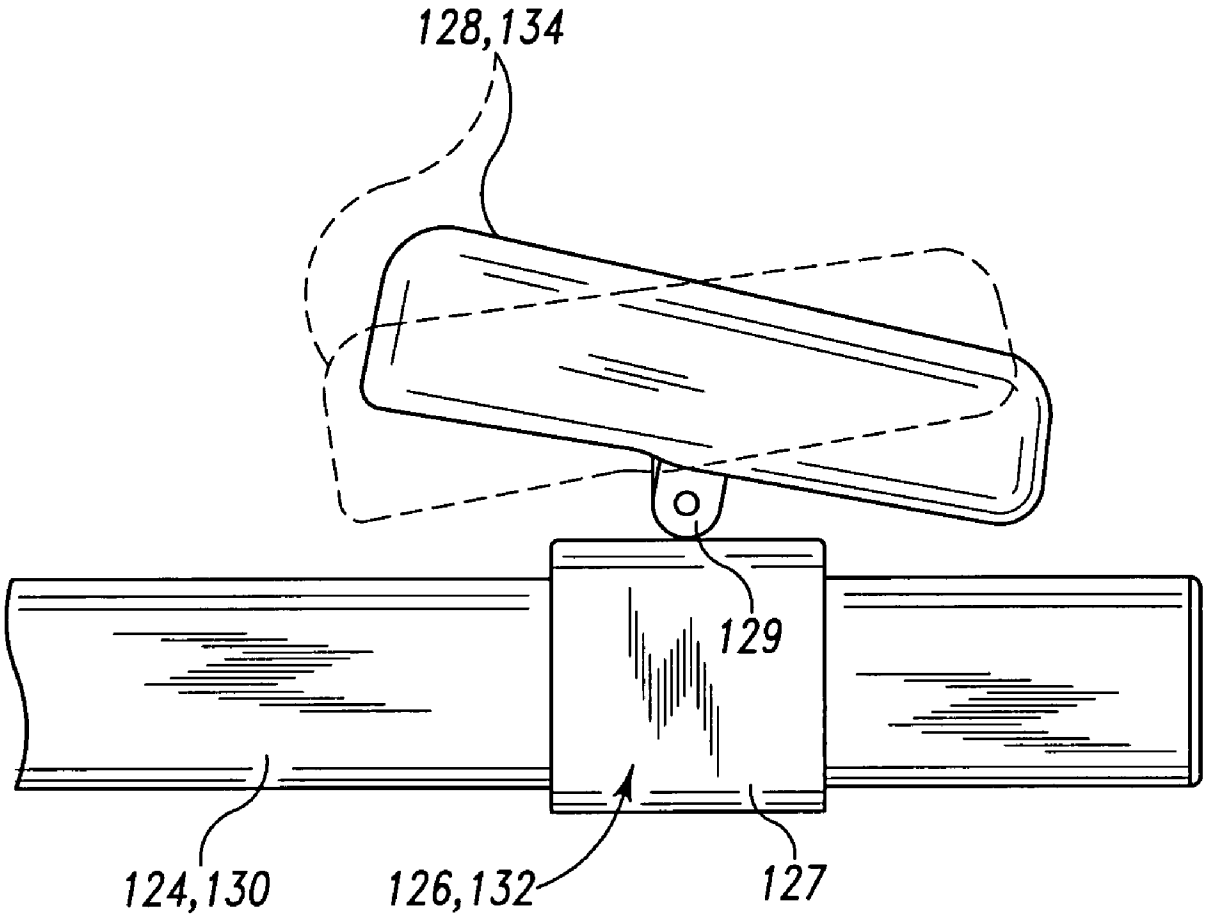
FIG. 4 is an elevation view of a support member articulably mounted to a support arm.

In one embodiment, shown in further detail in FIG. 4, mounting members 126, 132 each include a running sleeve 127 that slides along the respective support arm 124, 130 to longitudinally translate in response to movement of the leg supports 121*a*, 121*b* with leg positioner system 136. The running sleeves 127 may be provided with plastic bushing therein that extend about the respective support arm 124, 130 to provide frictional resistance to maintain the longitudinal positioning of the support member 128, 134 along the respective support arm 124, 130 until the support arm 124, 130 is moved with leg positioner system 136. The translational movement of the support members 128, 134 allows repositioning of the leg while minimizing potential injury to the patient that may result to the patient's skin if allowed to slide along the support member.

Furthermore, mounting members 126, 132 can be structured so that the respective support member 128, 134 mounted thereto can pivot relative to the respective support arm 124, 130 about a pivot connection 129. In one embodiment, the support members 128, 134 can pivot universally in all directions relative to the support arm 124, 130 to accommodate the positioning of the body of the patient thereon. In another embodiment, support members 128, 134 pivot axially in a direction along central axis 32. In one specific embodiment, the pivot angle can range up to about 20 to 25 degrees relative to an axis extending perpendicularly to the respective support arm 124, 130. In still a further embodiment, mounting members 126, 132 can be provided with a telescoping arm, cylinder, or other structure that allows adjustment in the height of the support member 128, 134 relative to the support arm 124, 130.

Leg support system 120 can be movable along frame system 12 to adjust the spacing between it and torso support system 80 to accommodate the height of the patient. Furthermore, while a hand crank 140 is shown in FIGS. 2 and 3, it is contemplated that the leg positioner system 136 for moving leg supports 121 through their range of motion may include motors, hydraulic systems, pneumatic systems, or other suitable systems that facilitate or impart the desired movement. The space between the support members of leg supports 121 provides an ideal location through which to place tubes, cords, and other devices that may be employed during the surgery. This allows such devices to be located away from the outer edges of the table and away from the locations in which the surgeon and other attendants stand and move during the surgery.

Referring now to torso support system 80, it includes pelvis support members 92*a*, 92*b* mounted to frame system 12 by support arm 94. Torso support system 80 also includes abdomen support members 88*a*, 88*b* mounted to frame system 12 with support arm 90. Torso support system 80 further includes chest support members 84*a*, 84*b* mounted to frame system 12 with support arm 86. Torso support system 80 may also include pectoral support members 94*a*, 94*b* mounted to frame system 12 with mounting member 95 (only one shown in FIG. 3 for support member 94*a*.) The respective pairs of support members are spaced from one another about opposite sides of central axis 82 to provide a space therebetween.

It is contemplated that torso support system 80 may include any one or combination of these pairs of support members. For example, pectoral support members 94*a*, 94*b* may be eliminated, or combined with chest support members 84*a*, 84*b*. Abdomen support members 88*a*, 88*b* may be eliminated or spaced sufficiently relative to the patient to allow the abdomen to be free hanging during the procedure. In other embodiments, the support arms to which the support members are mounted extend generally parallel to central axis 82. Support members 92*a*, 88*a*, and 84*a* can be mounted one axially extending support arm, and support members 92*b*, 88*b*, 84*b* can be mounted to another axially extending support arm.

Pelvis support members 92*a*, 92*b* can be mounted on support arm 94 with respective mounting members 93 (only one shown), abdomen support members 88*a*, 88*b* can be mounted on support arm 90 with mounting members 89 (only one shown), and chest support members 84*a*, 84*b* can be mounted to support arm 86 with mounting members 85 (only one shown.) The mounting members 85, 89, 93, 95 can allow the particular support member supported thereon to articulate to accommodate the anatomy and positioning of the patient thereon. For example, the support members can universally pivot relative to frame system 12, as indicated in part by arrows 102. The mounting members 85, 89, 93, 95 can also include telescoping members, cylinders or other structure that allows raising and lowering of the support member mounted thereon relative to frame system 12 as indicated by arrows 100. Raising or lowering of one or more support members along one side of central axis 32 may be employed to rotate the spinal column. Raising or lowering one or more pairs of support members relative to one or more other pairs of support members may be employed to flex or extend the cervical, thoracic or lumbar regions of the spine.

Surgical table system 10 includes head support system 40 having a support member 46 extending about a central opening 42. When in the prone position, for example, central opening 42 accommodates the face of the patient positioned on surgical table system 10 with support member 46 extending about the perimeter of the face. Other embodiments contemplate pins for skeletal fixation of the head, and support of the head laterally, anterior-laterally, or in the supine positions.

Support member 46 can be mounted to frame system 12 or torso support system 80 with mounting member 44. Support member 46 can be articulable so that it can be moved through a range of motion that mimics that range of motion of the patient's head with the cervical spine. Accordingly, the head of the patient can be positioned to place the cervical spine in flexion or extension, as indicated by arrow 49, and/or in lateral extension or flexion as indicated by arrow 47, and also to rotate the cervical spine as indicated by arrow 48. Head support system 40 can further be longitudinally translatable relative to frame system 12 to provide traction forces.

Mounting member 44 can be moved through manual cranks or handles, or by grasping support 46 to manually reposition it. In one embodiment, mounting member 44 includes a series of interconnected articulating segments that allow universal pivoting and repositioning of support member 46, while exhibiting sufficient stiffness and/or including locking mechanisms to maintain the positioning once attained. In another embodiment, mounting member 44 is a support arm that is articulably coupled to frame system 12 or torso support system 80 and movable to reposition head support member 46.

Surgical table system 10 may further be provided with arm support systems 60. Arm support systems 60 include respective ones of upper arm support arms 64*a*, 64*b* and lower arm support arms 66*a*, 66*b*. Upper arm support arms 64*a*, 64*b* articulably support respective ones of the upper arm support members 68*a*, 68*b*, and lower arm support arms 66*a*, 66*b* articulably support respective ones of the lower arm support members 70*a*, 70*b*. Lower arm support arms 66*a*, 66*b* are articulably coupled at one end to an end of upper arm support arms 64*a*, 64*b* to allow movement in a manner that mimics the range of motion of the elbow joint, as indicated in part by arrows 73*a*. Upper arm support arms 64*a*, 64*b* are articulably mounted to frame system 12 at respective ones of the junctions 72*a*, 72*b* in a manner that allows movement that mimics the range of motion of the shoulder joint, as indicated in part by arrows 74*a*.

As shown in FIG. 3, upper arm support member 68*a* can be mounted to upper arm support arm 64*a* with mounting member 78, and lower arm support member 70*a* can be mounted to lower arm support arm 66*a* with mounting member 76. The other support members 68*b*, 70*b* may be similarly mounted to the other respective support arms 64*b*, 66*b*. Mounting members 76, 78 can be configured as running sleeves that longitudinally translate along the respective support arm as it is moved to reposition the arm of the patient during surgery in a manner similar to that discussed above with respect to mounting members 126, 132. Furthermore, the support members 68, 70 can be mounted on the respective support arm 64, 66 with a mounting member that allows universal pivoting of the support member 68, 70 thereon. The articulating support members 68, 70 allow the arm portion of the patient supported thereon to assume and maintain a natural inclination during surgery and reduces stress on the arm portion as the arm of the patient is supported and repositioned during surgery.

Support arms 64, 66 can be coupled to one another by a single joint that allows multi-axial movement and positioning of the support arms 64, 66 relative to one another that mimics the range of motion of the elbow joint. In another embodiment, support arms 64, 66 are comprised of a series of articulating segments that are movable to reposition the arm of the patient but exhibit sufficient stiffness to maintain the positioning of the arm when movement is complete. Support arms 64, 66 can be moved manually by directly grasping the support arms or components thereof, or can be moved remotely through one or motors, hydraulic systems, pneumatic systems or other suitable system.

For any of the leg, torso, arm and head support systems, the support members may be comprised of a padded support that provides at least some conformance to the portion of the patient's body positioned thereon. It is further contemplated that the support members may include other features to facilitate support and repositioning of the patient and reduce the potential for pressure sores, friction burns and other stresses during surgery. The support members may include one or more inflatable and deflatable chambers, rollers, or other device to change the characteristic of the supporting surface during surgery. In addition, any one or combination of support members may include a vibrating element, heating element, cooling element, or other therapy-providing element that allows therapy to be provided during surgery. The support members can be manipulated for lateral force application to the supported portion of the patient's body to facilitate rotation or lateral flexion of a joint, the spinal column, or other structure of the patient's body.

Still other embodiments contemplate pressure sensing in any one or combination of the support members to measure pressure or other forces on the supported portion of the patient's body. The measurements can provide feedback to the surgeon regarding forces exerted on the support portions of the patient's body during manipulation and allow corrective or alternate measures to be taken during the surgical procedure.

Referring back to FIG. 1, surgical table system 10 may further be provided with a control system 20 linked to each of the support systems 40, 60, 80 and 120. In the illustrated embodiment, control system 20 is centralized, and is operable by the surgeon or other attendant to adjust the positioning of one or more components of any one of the support systems 40, 60, 80, 120. Control system 20 may communicate with leg support system 120 via link 22. Control system 20 may communicate with torso support system 80 via link 24, and control system 20 may communicate with arm support systems 60*a* and 60*b* via links 26*a* and 26*b*. Control system 20 may also communicate with head support system 40 via link 28. Links 22, 24, 26 and 28 may include any one or combination of electrical wires, pneumatic or hydraulic tubing, optical, infrared or other remote communication systems coupled between control system 20 and respective ones of the support systems 40, 60, 80, 120. Control system 20 and the respective links can allow adjustment in the positioning or condition of any of support systems 40, 60, 80, 120 or the support members thereof in response to operator input.

It is also contemplated that a decentralized control system may be provided with individual controls for each of the support systems. It is still further contemplated that controls may be provided for each component of any particular support system. The control systems may also be combined so that the attendant may optionally control support systems 40, 60, 80, 120 through a central controller, through a controller dedicated to a particular support system, or through a controller dedicated to a particular component of a support system.

Control system 20 and any other control system embodiment may include input devices assigned to respective ones of the support systems 40, 60, 80, 120 that allow the operator to input data that raises, lowers, pivots, rotates, translates, elongates, compresses, inflates, vibrates, heats, cools, repositions, or otherwise adjusts one or more the support systems 40, 60, 80, 120 and support members of the support systems. Control system 20 may include one or more controllers with memory that allows any one or more particular positioning of the components to be stored to facilitate return to that positioning during the surgical procedure should it be desired to do so. Control system 20 may include one or more display screens, position indicators, alarms, charts, graphs, gauges, dials, sensors, or other output devices to provide an indication of the positioning any of the support systems 40, 60 80, 120 and/or of one or more components of any of the support systems 40, 60, 80, 120.

Control system 20 may include one or more controllers configured as a single unit for all components and systems, or configured in multi-controller form for any subsets of components and systems. The controller(s) may be programmable, state logic machines or other type of dedicated hardware, or a hybrid combination of programmable and dedicated hardware. One or more components of the controller(s) may be of the electronic variety defining digital circuitry, analog circuitry, or both. As an addition or alternative to electronic circuitry, the controller may include one or more mechanical or optical control elements. The controller may include an integrated processing unit operatively coupled to one or more solid-state memory devices containing programming to be executed by the processing unit in accordance with one or more routines executed by the processing unit. In addition to memory, the controller may also include any control clocks, timers, interfaces, input devices, display devices, signal conditioners, filters, limiters, Analog-to-Digital (A/D) converters, Digital-to-Analog (D/A) converters, communication ports, or other types of operators.

In one aspect, at least one of the arm support systems, torso support systems and leg support systems includes multiple support members to provide multiple support locations for the particular portion of the patient's body being supported in a facedown position thereon. The multiple support members are supported relative to a frame of the surgical table via mounting members. The mounting members may be provided with any suitable structure that allows articulation of the support members relative to the frame.

In another aspect, the mounting members may be secured to the frame in a manner that allows adjustment of any of the support systems relative to the other support systems. For example, the leg support system may allow the legs of the patient to be repositioned relative to the torso at any location between a first position where the knees of the patient are deeply bent and positioned below the torso to place the lumbar portion of the spinal column in flexion to a second position where the legs are positioned above the torso to place the lumbar portion of the spinal column in extension. In another example, the head support system can be moved relative to the torso support system to extend, flex and/or rotate the cervical portion of the spinal column. In a further example, each of the arm support systems are movable relative to the torso support system to reposition the arms in a manner that mimics the range of motion of the shoulder joint and the elbow joint. In a further example, support members of any of the support members are longitudinally movable along frame system 12 to provide traction or compression of the supported bony structures. In another example, any one or more of the support members is elongateable longitudinally to provide traction of compression of the supported bony structure.

With regard to the torso support system, it may comprise any one or more pairs of support members for supporting the pelvis, chest and pectorals of the patient. The members of the respective support member pairs are positioned on opposing sides of the central axis of the spinal column and the surgical table system to provide balanced support of the torso. Any one or combination of the support members of the torso support system can be adjustable in height relative to the other support members to allow selective raising or lowering of the chest, abdomen, pectorals, and/or pelvis relative to the other. Furthermore, any one or combination of support members along one side of the patient may be selectively raised or lower relative to the other side to adjust the body position in the coronal plane by raising or lowering one side of the pelvis, abdomen, chest and/or pectoral of the patient to rotate the spinal column.

With regard to the arm and leg support systems, each can be provided with an arm or leg support that includes a support member on opposing sides of a joint so that the individual support members of the particular support system may be repositioned relative to one another in a manner that mimics that natural range of motion of an elbow or knee joint, respectively. The arm support systems are independently moveable relative to one another and to the frame system. The leg support system includes a pair of support arms with support members for each of the upper and lower portion of each leg of the patient. The support arms are movable in conjunction with one another to raise and lower the legs of the patient.

The frame system of the surgical table system may include at least one stanchion for supporting the support systems above the floor, and at least one rail extending from the at least one stanchion and along the support systems to which the support systems are mounted. In one embodiment, the at least one rail comprises a pair of rails, and the at least one stanchion comprises a pair of stanchions at opposite ends of the pair of rails. The rails are adjustably secured to the stanchions to adjust a height of the rails relative to the floor. In another embodiment, a stanchion is centrally located along the rails, and includes a cylinder or jack type of arrangement to allow the height of the support systems relative to the floor to be adjusted. In any embodiment, the surgical table system may include other accessories, such as instrument trays and receptacles, as may be found in a typical surgical table. One or more components of the support systems and/or frame system of the surgical table system may be made from X-ray transparent components to facilitate the use of imaging or navigation tracking devices to allow visualization and tracking of dynamic movement and anatomical navigation during the surgical procedure.

It is further contemplated that the surgical table system can be employed to manipulate the spine, legs, arms, torso, and head facilitate surgical treatment and access to the desired anatomical structures in the patient. For example, in spinal surgical procedures, the torso of the patient can be manipulated to provide nerve root decompression, or to manipulate vertebrae to facilitate access to the spinal disc space for a particular approach, including posterior, posterior-lateral, lateral, anterior-lateral, and anterior approaches. The surgical table system can be employed for surgical procedures on any one of the arms, head, torso, and legs. The surgical table system also facilitates surgeon access to and control of the patient for combined simultaneous surgeries where surgical procedures on more than one portion of the patient's body may be desired, such as in trauma surgery. Applications for arm surgeries, shoulder surgeries, cranial surgeries, spinal surgeries, thoracic surgeries, abdomenal surgeries, leg surgeries, vascular surgeries, plastic surgeries and other orthopedic surgeries are contemplated.

While the invention has been illustrated and described in detail in the drawings and foregoing description, the same is to be considered as illustrative and not restrictive in character. All changes, modifications and equivalents that come within the spirit of the invention as defined by the following claims are desired to be protected.

What is claimed is:

1. A surgical table system for supporting a patient during a spinal surgical procedure, comprising:

a frame system to support the surgical table system above the ground; and a head support system, a torso support system, a pair of arm support systems, and a leg support system, said support systems being positioned along said frame system to support the patient in a position during the surgical procedure, and wherein when in the position said torso support system is structured to support a torso of the patient generally in a first plane and said leg support system is movable relative to said torso support system from a first position where a lumbar portion of the spine is placed in flexion with knees of the patient below said first plane to a second position where the lumbar portion of the spine is placed in extension with knees of the patient above said first plane.

2. The surgical table system of claim 1, wherein said leg support system comprises a first pair of support members for supporting one of the patient's legs and a second pair of support members adjacent said first set of support members for supporting the other of the patient's legs.

3. The surgical table system of claim 2, wherein said first and second pairs of support members each include a lower leg support member and an upper leg support member spaced from said lower leg support member.

4. The surgical table system of claim 3, wherein said upper leg support members are spaced from one another to define an opening therebetween to receive at least one of cords, tubes, and wires therethrough.

5. The surgical table system of claim 3, wherein each of said upper leg support members is articulably mounted on a corresponding upper leg support arm and each of said lower leg support members is articulably mounted on a corresponding lower leg support arm, said lower leg support arms being pivotally coupled with a respective one of said upper leg support arms.

6. The surgical table system of claim 5, wherein said upper leg support members and said lower leg support members are each translatable along said respective support arm as said leg support system is moved between said first and second positions.

7. The surgical table system of claim 5, wherein each of said upper leg support arms are coupled at one end thereof with a leg positioner system, said leg positioner system being mounted to said frame system and being operable to move said leg support system between said first and second positions.

8. The surgical table system of claim 7, wherein said leg support system is movable along said frame system to adjust a separation distance between said torso support system and said leg support system.

9. The surgical table system of claim 1, wherein said torso support system includes a plurality of pairs of torso support members, one pair of said torso support members being positioned along said frame system to support opposite sides of the abdomen of the patient and another pair of said torso support members being positioned along said frame system to support opposite sides of the chest of the patient.

10. The surgical table system of claim 9, wherein said support members of said respective pairs of support members lie on opposite sides of a central axis of said frame system and define a space therebetween along said central axis.

11. The surgical table system of claim 9, wherein at least one of said torso support members is height adjustable relative to said first plane.

12. The surgical table system of claim 9, wherein each of said torso support members is articulably mounted to said frame.

13. The surgical table system of claim 9, wherein another of said pairs of torso support members includes a pair of pectoral support members positioned along said frame system to support respective ones of the pectorals of the patient.

14. The surgical table system of claim 9, wherein another of said pairs of torso support members includes a pair of pelvis support members adjacent said leg support system and positioned along said frame system to support respective sides of the pelvis of the patient.

15. The surgical table system of claim 1, wherein said head support system is movable relative to said first plane between a first position where the cervical spine of the patient is in flexion and a second position where the cervical spine of the patient is in extension.

16. The surgical table system of claim 1, wherein each of said arm support systems includes an upper arm support member articulably mounted on an upper arm support arm and a lower arm support member articulably mounted on a lower arm support arm.

17. The surgical table system of claim 16, wherein said lower arm support arm is articulably coupled to said upper arm support arm, and said upper arm support arm is articulably coupled to said frame system.

18. The surgical table system of claim 17, wherein said upper arm support member and said lower arm support member are each translatable along said respective upper arm and lower arm support arms.

19. The surgical table system of claim 1, wherein each of said arm support systems, said torso support system, and said leg support system includes at least two support members articulably mounted to said frame.

20. A surgical table system for supporting a patient during a spinal surgical procedure, comprising:

a frame system to support the surgical table system above the ground; and a torso support system, a leg support system movable along said frame system to adjust a separation distance between said torso support system and said leg support system, and a head support system, wherein each system is mounted to said frame system to support the patient in a position during the surgical procedure, wherein in the position said torso support system is structured to support a torso of the patient generally in a first plane, and said leg support system is movable relative to said first plane between first and second positions so that a lumbar portion of the spine can be manipulated for flexion and extension and said head support system is movable between first and second positions relative to said first plane so that a cervical portion of the spine of the patient can be manipulated for flexion and extension.

21. The system of claim 20, wherein said leg support system is movable relative to said torso support system from the first position where the lumbar portion of the spine is placed in flexion with knees of the patient below said first plane to the second position where the lumbar portion of the spine is placed in extension with knees of the patient above said first plane.

22. The surgical table system of claim 20, wherein said leg support system comprises a first pair of support members for supporting one leg of the patient and a second pair of support members adjacent said first set of support members for supporting another leg of the patient.

23. The surgical table system of claim 22, wherein said first and second pairs of support members each include a lower leg support member and an upper leg support member spaced from said lower leg support member.

24. The surgical table system of claim 23, wherein said upper leg support members are spaced from one another to define an opening therebetween to receive at least one of cords, tubes, and wires therethrough.

25. The surgical table system of claim 23, wherein each of said upper leg support members is articulably mounted on a respective upper leg support arm and each of said lower leg support members is articulably mounted on a respective lower leg support arm, each of said lower leg support arms being articulably coupled to a respective one of said upper leg support arms.

26. The surgical table system of claim 25, wherein said upper leg support members and said lower leg support members are translatable along said respective support arm as said leg support system is moved between said first and second positions.

27. The surgical table system of claim 25, wherein each of said upper leg support arms are coupled with a leg positioner at an end opposite said respective lower leg support arm coupled thereto, said leg positioner system being mounted to said frame system and being operable to pivot said upper leg support arms to move said leg support system between said first and second positions.

28. The surgical table system of claim 20, further comprising a pair of arm support systems extending from respective sides of said frame system, wherein each of said arm support systems includes an upper arm support member articulably mounted to an upper arm support arm and a lower arm support member articulably mounted to a lower arm support arm.

29. The surgical table system of claim 28, wherein said lower arm support arm is articulably coupled to said upper arm support arm.

30. A surgical table system for supporting a patient during a spinal surgical procedure, comprising:

a frame system to support the surgical table system above the ground; and a torso support system, a leg support system, and a head support system mounted to said frame system to support the patient in a position during the surgical procedure, wherein in the position said torso support system is structured to support a torso of the patient generally in a first plane, and said leg support system is movable relative to said first plane between first and second positions so that a lumbar portion of the spine can be manipulated for flexion and extension and said head support system is movable between first and second positions relative to said first plane so that a cervical portion of the spine of the patient can be manipulated for flexion and extension, wherein said torso support system includes a plurality of pairs of torso support members, one pair of said torso support members being positioned along said frame system to support opposite sides of the abdomen of the patient and another pair of said torso support members being positioned along said frame system to support opposite sides of the chest of the patient.

31. The surgical table system of claim 30, wherein said support members of said respective pairs of support members lie on opposite sides of a central axis of said frame system and define a space therebetween along said central axis.

32. The surgical table system of claim 30, wherein each of said torso support members is height adjustable relative to said first plane.

33. The surgical table system of claim 30, wherein each of said torso support member is articulably mounted to said frame.

34. The surgical table system of claim 30, further comprising a pair of pectoral support members positioned along said frame system to support respective ones of the pectorals of the patient.

35. The surgical table system of claim 30, further comprising a pair of pelvis support members positioned on said frame system adjacent said leg support system to support respective sides of the pelvis of the patient.

36. A surgical table system for supporting a patient during a spinal surgical procedure, comprising:

a frame system to support the surgical table system above the ground;

a plurality of support systems, at least one support system being provided for a torso, legs and each arm of the patient to support the patient in a position during the surgical procedure, wherein:

each of the arm support systems includes an upper arm support member for supporting the upper arm and a lower arm support member for supporting the lower arm;

the leg support system includes a pair of lower leg support members for respective ones of the lower legs of the patient and a pair of upper leg support members for respective ones of the upper legs of the patient; and each of said support members is articulably mounted to an adjacent support arm.

37. The surgical table system of claim 36, wherein said articulably mounted support members are each translatable along said adjacent support arm.

38. The surgical table system of claim 37, wherein said support arm for said upper arm support member and said support arm for said lower arm support member are articulably coupled to one another.

39. The surgical table system of claim 37, wherein said support arms for said upper leg support members are articulably coupled to a respective one of said support arms for said lower arm support members.

40. The surgical table system of claim 36, wherein the position is a prone position and said torso support system is structured to support a torso of the patient generally in a first plane and said leg support system is movable relative to said torso support system from a first position wherein a lumbar portion of the spine is placed in flexion with knees of the patient below said first plane to a second position wherein the lumbar portion of the spine is placed in extension with knees of the patient above said first plane.

41. A surgical table system for supporting a patient during a spinal surgical procedure, comprising:

a frame system to support the surgical table system above the ground; and a plurality of support systems, at least one support system being provided for each arm, torso, and legs of the patient to support the patient in a position during the surgical procedure, and wherein each of said support systems includes at least two articulable support members each directly supporting a respective adjacent body portion of the patient thereon when in the position.

42. The surgical table system of claim 41, wherein said at least two articulable support members of said leg support system include a first pair of articulable support members for supporting an upper portion and a lower portion of one leg of the patient and a second pair of articulable support members for supporting the upper and lower portions of another leg of the patient.

43. The surgical table system of claim 42, wherein each of said support members of said leg support system is translatable along a support arm supporting said respective support member.

44. The system of claim 43, wherein said torso support system supports a torso of the patient generally in a first plane and said support members of said leg support system are movable relative to said torso support system from a first position where a lumbar portion of the spine is placed in flexion with knees of the patient below said first plane to a second position where the lumbar portion of the spine is placed in extension with knees of the patient above said first plane.

45. The surgical table system of claim 41, wherein said at least two articulable support members of each of said arm support systems includes a first articulable support member for supporting an upper portion of an arm of the patient and a second articulable support member for supporting the lower portion of the arm of the patient.

46. The surgical table system of claim 45, wherein said first and second articulable support members of each of said arm support systems is translatable along a respective support arm.

47. The surgical table system of claim 46, wherein said respective support arms of each of said arm support systems are articulably coupled to one another.

48. The surgical table system of claim 41, further comprising a head support system for supporting the head of the patient, said head support system being movable relative to said torso support system to position a cervical portion of the spine of the patient in flexion and extension.

49. The surgical table system of claim 48, wherein said leg support system is movable relative to said torso support system to move legs of the patient to position a lumbar portion of the spine in flexion and extension.

50. The surgical table system of claim 41, wherein said torso support system includes a first pair of support members positioned along said frame system to support respective sides of a pelvis of the patient, a second pair of support members positioned along said frame system to support respective sides of an abdomen of the patient, and a third pair of support members positioned along said frame system to support respective sides of a chest of the patient.

51. The surgical table system of claim 50, wherein each of said support members of said torso support system is height adjustable relative to said frame system.

52. The surgical table system of claim 50, wherein said torso support system includes a fourth pair of support members to support respective ones of the pectorals of the patient.

53. A surgical table system for supporting a patient during a spinal surgical procedure, comprising:

a frame system to support the surgical table system above the ground;

a head support system, a torso support system, a pair of arm support systems, and a leg support system, said support systems being positioned along said frame system to support the patient in a position during the surgical procedure, and wherein when in the position said torso support system is structured to support a torso of the patient generally in a first plane and said leg support system is movable relative to said torso support system from a first position where a lumbar portion of the spine is placed in flexion with knees of the patient below said first plane to a second position where the lumbar portion of the spine is placed in extension with knees of the patient above said first plane; and wherein said leg support system includes a first pair of support members and a second pair of support members and wherein said first pair of support members and said second pair of support members are each translatable along said leg support system as said leg support system is moved between said first and second positions.

54. The surgical table system of claim 53, wherein said first pair of support members is structured to support one of the patient's legs and said second pair of support members is structured for supporting the other of the patient's legs.

55. The surgical table system of claim 54, wherein said first and second pairs of support members each include a lower leg support member and an upper leg support member spaced from said lower leg support member.

56. The surgical table system of claim 55, wherein each of said upper leg support members is articulably mounted on a corresponding upper leg support arm and each of said lower leg support members is articulably mounted on a corresponding lower leg support arm, said lower leg support arms being pivotally coupled with a respective one of said upper leg support arms.

57. The surgical table, system of claim 53, wherein said leg support system is moveable along said frame to adjust a separation distance between said torso support system and said leg support system.

* * * * *